US010730723B1

(12) United States Patent
Spitsbergen

(10) Patent No.: US 10,730,723 B1
(45) Date of Patent: Aug. 4, 2020

(54) TRANSPORTABLE MOUNTING APPARATUS FOR PORTABLE HOIST SYSTEMS

(71) Applicant: Michael Spitsbergen, La Mesa, CA (US)

(72) Inventor: Michael Spitsbergen, La Mesa, CA (US)

( * ) Notice: Subject to any disclaimer, the term of this patent is extended or adjusted under 35 U.S.C. 154(b) by 335 days.

(21) Appl. No.: 15/498,392

(22) Filed: Apr. 26, 2017

(51) Int. Cl.
*B66C 23/16* (2006.01)
*B66C 23/44* (2006.01)
*B66C 23/48* (2006.01)
*B66C 23/68* (2006.01)

(52) U.S. Cl.
CPC ..... *B66C 23/166* (2013.01); *B66C 23/44* (2013.01); *B66C 23/48* (2013.01); *B66C 23/68* (2013.01)

(58) Field of Classification Search
CPC ..... B66C 23/166; B66C 23/44; B66C 23/48; B66C 23/68; A63B 71/0669
See application file for complete search history.

(56) References Cited

U.S. PATENT DOCUMENTS

| | | | | |
|---|---|---|---|---|
| 873,076 | A | 12/1907 | Olsen et al. | |
| 1,247,706 | A | 11/1917 | Moran | |
| 1,377,063 | A | 5/1921 | Gaj | |
| 1,471,971 | A * | 10/1923 | Miller | B66C 23/60 212/231 |
| 2,305,202 | A | 12/1942 | Smith | |
| 2,487,305 | A | 11/1949 | Bridegroom | |
| 2,496,401 | A | 2/1950 | McKinney | |
| 2,592,993 | A | 4/1952 | Adams | |
| 2,670,086 | A | 2/1954 | Eisberg | |
| 2,717,751 | A | 9/1955 | Kusiv | |
| 2,888,111 | A | 5/1959 | Evans | |
| 3,060,614 | A | 10/1962 | Prince | |
| 3,121,556 | A | 2/1964 | Faulkner | |
| 3,638,806 | A | 2/1972 | Hippach | |
| 3,802,653 | A | 4/1974 | Nyulassie | |
| 3,845,869 | A | 11/1974 | Sowers et al. | |
| 3,879,907 | A | 4/1975 | Olson | |
| 4,030,733 | A | 6/1977 | Merrihew et al. | |
| 4,082,161 | A | 4/1978 | Johnson | |
| 4,171,116 | A | 10/1979 | Carver | |
| 4,600,348 | A | 7/1986 | Pettit | |
| 4,671,731 | A | 6/1987 | Harlan | |
| 4,709,783 | A | 12/1987 | Tomioka et al. | |
| 4,714,226 | A | 12/1987 | Tracy | |
| 4,833,566 | A | 5/1989 | Nickola | |
| 4,880,346 | A | 11/1989 | Brassette | |
| 5,064,078 | A | 11/1991 | Van Staveren | |
| 5,211,297 | A | 5/1993 | Vandervalk | |
| 5,211,526 | A | 5/1993 | Robinette | |
| 5,316,265 | A | 5/1994 | Welch et al. | |
| 5,341,898 | A | 8/1994 | Baziuk | |
| 5,431,526 | A | 7/1995 | Peterson et al. | |

(Continued)

*Primary Examiner* — Sang K Kim
*Assistant Examiner* — Nathaniel L Adams
(74) *Attorney, Agent, or Firm* — Thomas M. Freiburger

(57) ABSTRACT

A portable hoist apparatus includes a boom secured to a frame or body, which includes, at a side opposite the boom, a cylindrical mounting collar, on a vertical axis, can be slipped over a cylindrical pivot tube that in turn is connected to any of a number of different base mounting structures that are configured to be attached to various stable anchoring structures, such as on buildings, decks, posts, vehicles, floors and many other structures.

4 Claims, 18 Drawing Sheets

(56) References Cited

U.S. PATENT DOCUMENTS

| | | | |
|---|---|---|---|
| 5,445,281 | A | 8/1995 | Hung |
| 5,445,487 | A | 8/1995 | Koscinski, Jr. |
| 5,456,433 | A | 10/1995 | Burns et al. |
| 5,564,453 | A | 10/1996 | Steiner |
| 5,584,363 | A | 12/1996 | Curtin et al. |
| 5,622,237 | A | 4/1997 | Moldow |
| 5,662,451 | A | 9/1997 | Muzzi et al. |
| 5,667,352 | A | 9/1997 | Curtin et al. |
| 5,725,112 | A | 3/1998 | Thorby |
| 5,752,799 | A | 5/1998 | Carey et al. |
| 5,788,095 | A | 8/1998 | Watson |
| 5,800,117 | A | 9/1998 | Milton |
| 5,816,554 | A | 10/1998 | McCracken |
| 5,897,101 | A | 4/1999 | Snyder |
| 6,038,829 | A | 3/2000 | Franks |
| 6,065,621 | A | 5/2000 | Fatemi et al. |
| 6,135,300 | A | 10/2000 | Fox |
| 6,138,991 | A | 10/2000 | Myers |
| 6,152,675 | A | 11/2000 | Compton |
| 6,276,665 | B1 | 8/2001 | Hawkins et al. |
| 6,478,172 | B2 | 11/2002 | Zingerman |
| 6,499,610 | B2 | 12/2002 | Spitsbergen |
| 6,821,075 | B2 | 11/2004 | van der Horn |
| 6,926,120 | B1 | 8/2005 | Bradley |
| 6,983,157 | B2 | 1/2006 | Yamagishi et al. |
| 7,044,313 | B2 | 5/2006 | Haliburda, III |
| 7,407,039 | B2 | 8/2008 | Bailey |
| 7,419,347 | B1 | 9/2008 | Cormier |
| 7,537,088 | B2 * | 5/2009 | Spitsbergen ..... B66C 23/208 187/240 |
| 9,073,735 | B2 * | 7/2015 | Byrd ..... B66C 23/48 |
| RE46,619 | E * | 12/2017 | Chilton |
| 2004/0256607 | A1 | 12/2004 | Spitsbergen |
| 2005/0236352 | A1 | 10/2005 | Tien |
| 2008/0063497 | A1 | 3/2008 | Spitsbergen |
| 2008/0197095 | A1 | 8/2008 | Spitsbergen |
| 2008/0217277 | A1 | 9/2008 | Spitsbergen |
| 2009/0173707 | A1 | 7/2009 | Spitsbergen |
| 2009/0173709 | A1 | 7/2009 | Spitsbergen |
| 2014/0093346 | A1 * | 4/2014 | Kent ..... B63C 15/00 414/744.2 |
| 2015/0086367 | A1 * | 3/2015 | Holloway ..... B66C 23/207 416/146 R |

* cited by examiner

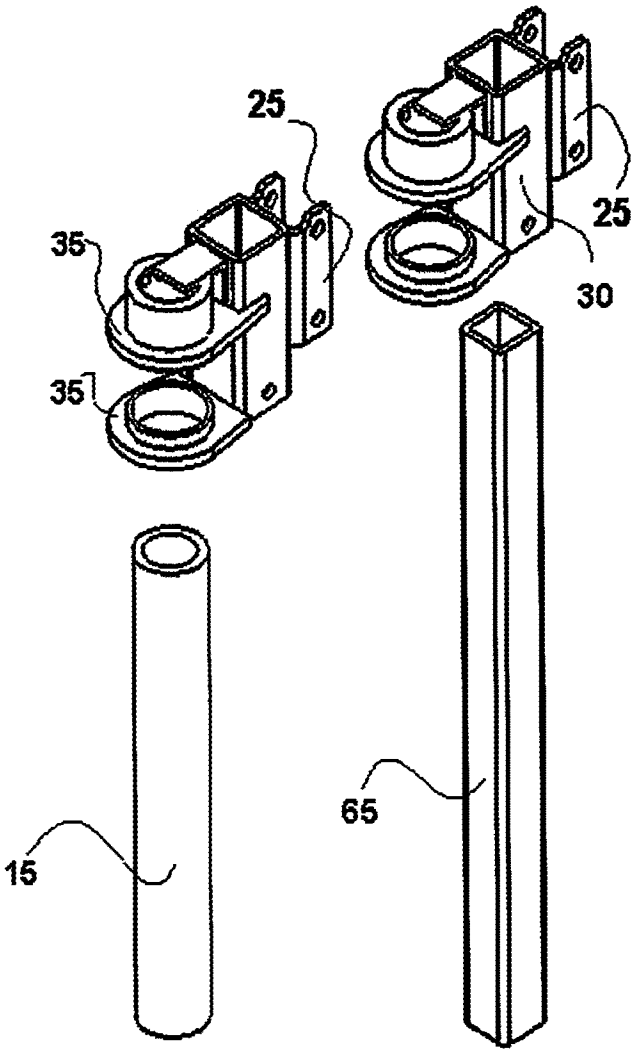
FIG. 5F
FIG. 5E
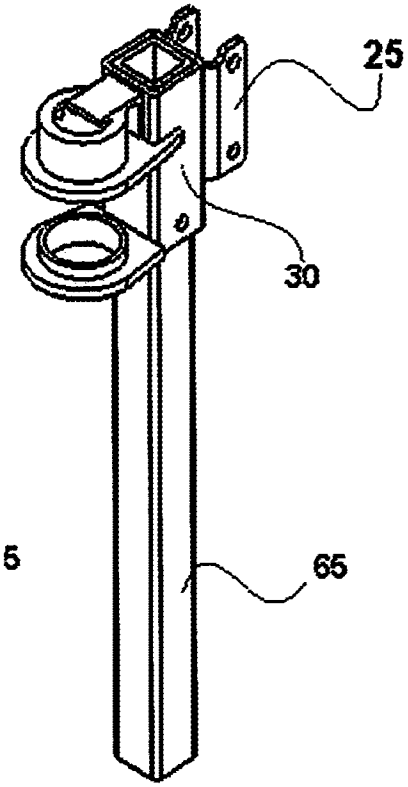
FIG. 5D
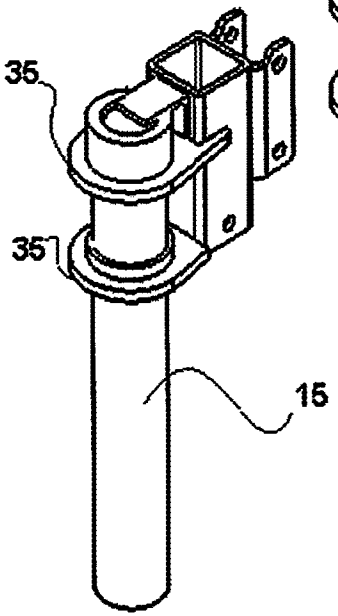
FIG. 5C

TRANSPORTABLE MOUNTING APPARATUS FOR PORTABLE HOIST SYSTEMS

BACKGROUND OF THE INVENTION

The present invention is concerned with a portable hoist system, and in particular relates to a removable mounting body and versatile mounting bases in such portable hoist systems.

An example of a portable hoist system is shown in U.S. Pat. No. 6,499,610. The portable hoist system is shown with a boom arm, a support strut, and a body or frame to which the boom and strut are attached, the support strut having a release mechanism to allow a user to fold the assembly for portability.

The portable hoist system of U.S. Pat. No. 6,499,610 allows for portability, but not easy removal of the hoist assembly from the base to allow a user to quickly and safely reposition the system on a different base. The safety features could be improved, as well as the ease of setup and removal of the system from the base. Accordingly, there remains a need in the art for a safer, more easily set up and movable portable hoist system with removability of the hoist system from a base or mount to allow a user to switch the system to different locations safely and easily with the use of various base mounts.

U.S. Pat. No. 7,537,088 also describes features of a portable hoist assembly. Both the '088 patent and the '610 patent referenced above are fully incorporated herein by reference.

It is an object of this invention to overcome problems involved in use of relatively light-duty hoists at multiple locations, by providing a safer, simpler and more easily used arrangement of a portable, foldable hoist assembly that is quickly set up and moved and compactly stowable. Another object, in a specific embodiment of the invention, is to facilitate release of the hoist system and portability of the entire assembly by a single person, while retaining the hoist assembly as one unit.

The present invention provides improvements to the features of the system as shown in U.S. Pat. No. 6,499,610 by providing a safer, more conveniently and easily movable portable hoist system with a removable mounting device and various base mounts for safely, quickly and easily repositioning the hoist system at various locations as needed.

In the bed of pickup trucks, in the trunks of automobiles, on trailers, in the back of vans, in boats, and on the tops of buildings or in elevator shafts, as well as in many industrial and military applications, it is not practical or economical to mount a permanent hoist for the lifting of loads. Accordingly, there remains a need in the art for a portable hoist system which may be easily installed and easily repositioned for use on the top of a building, in the bed of a truck, in the trunk of an automobile, in the back of a van, in boats, on a trailer, and in other similar applications and which is lightweight, easily assembled, inexpensive, and may be easily moved from place to place preferably by one person in a compact carrier, thereby providing an individual with the ability to lift loads generally requiring more than one person to properly manage.

Further, there remains a need in the art for a safer portable hoist system, one that is easily removed from the base or body and can be mounted to various base mounts in various different situations as needed. With the addition of a removable mounting device and various base mounts, problems of difficulty in setup, assembly of components, a need for multiple hoist assemblies, or loss of time for moving a portable hoist are overcome, as explained below.

SUMMARY OF THE INVENTION

The hoist assembly of the invention, including features for supporting the hoists or a hoist of the type described in U.S. Pat. No. 6,499,610, as well as hoists disclosed in copending application Ser. No. 15/498,306, solve problems of the need to reposition the entire hoist system by allowing a user safely and easily to remove the hoist system from the base, while also solving problems of time to set up a base assembly or cost to purchase additional units, by allowing a user to quickly remove the hoist assembly from a base or anchoring mount and mount it to any of various other bases. The setup and the removal are both quick and efficient. In addition, the invention in one preferred embodiment allows a single user to manipulate the assembly and carry it easily to different locations.

In one embodiment, a removable mounting body for a portable hoist assembly comprises a bracket at one end connected to a boom. To the bracket is connected a mounting collar, which can be comprised of two (or more) spaced bushing collars, one above the other. The bracket preferably also supports a boom support strut or brace, both the boom and brace being pivotally connected to the bracket. The mounting collar(s) can be connected indirectly to the bracket, with a tubular structural member between. This can be a square or other non-round tube, for purposes explained below.

For setting up the portable hoist, the mounting collar is simply slipped over a cylindrical structural pivot tube, which in turn is supported by other base structure which provides a stable anchoring for the hoist. In use the hoist can be swiveled about the cylindrical tube, via the mounting collar, acting as a rotational bearing. This arrangement provides portability while retaining the pieces of the hoist assembly as one unit, which makes it a safer and more efficient assembly. The mounting collar of the hoist assembly body can easily be removed from the pivot tube in preferred embodiments of the invention. The hoist assembly can then be placed on a different pivot tube at a different location in such a preferred embodiment.

Various base mounts can be mounted at different locations such as in the back of a pickup truck, in the back of vans, on rolling carts, on stands on the tops of buildings, towers or platforms, in boats or even in aircraft and other applications.

The portable hoist system of the invention in one preferred embodiment is a lightweight, easily and safely set up, inexpensive system which may be easily moved in a compacted size from place to place, with the benefits of a removable mounting body and various anchoring bases, thus providing the ability to move loads to or from the roof of a building, to or from the cargo space of a vehicle, a trailer, or any other type of transport system, or in any confined space, and safely move the portable hoist system to different positions while retaining the components of the system as one unit. The weight of the hoist assembly preferably (but not necessarily) is less than 50 pounds, and more preferably around 40 pounds (plus or minus 10%).

In a preferred aspect of the invention, the load to weight ratio of the portable hoist system is at least 35, or more broadly, in a range of about 15 to 40, or 20 to 40.

In another preferred aspect, the position of connection of the support strut to the body is less than six inches below the boom's pivotal securement to the body. Also, the support strut preferably comprises an adjustable mechanism, with quick adjustment of the strut's length so as to adjust the height of the boom's outer end from which a tension line extends.

Accordingly, a principal object of the invention is to provide a simple and safe and easily removable and repositionable portable hoist system. These and other objects, advantages and features of the invention will be apparent from the following description of preferred embodiments, considered along with the accompanying drawings.

DESCRIPTION OF THE DRAWINGS

FIGS. 5C and 5D are perspective views showing the mounting situations of FIGS. 5A and 5B.

FIGS. 5E and 5F are perspective views similar to FIGS. 5C and 5D but showing the mounting body removed from the respective base mounts.

DESCRIPTION OF PREFERRED EMBODIMENTS

Figure 1:
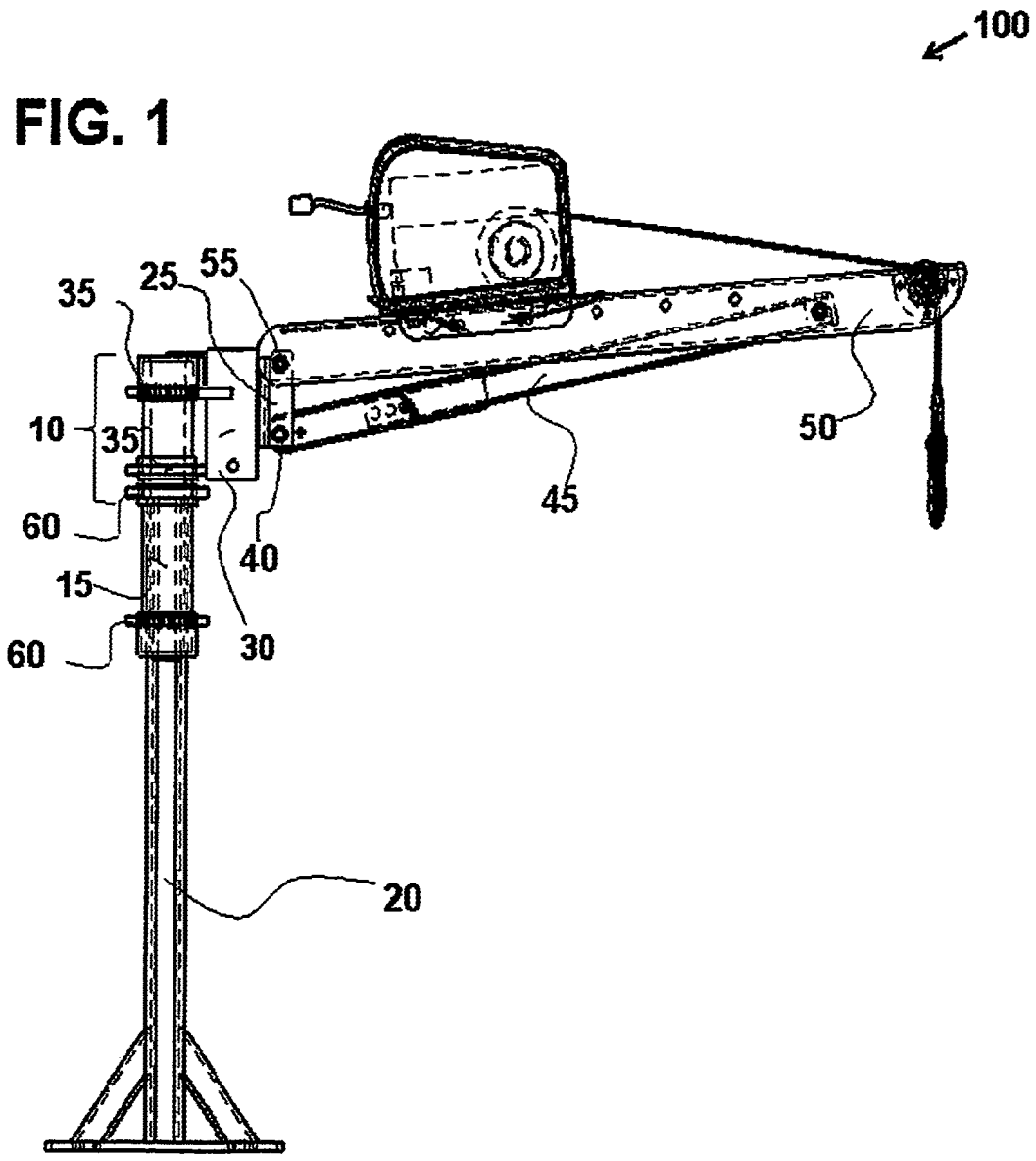
FIG. 1 is a side elevation view of a first embodiment of the hoist assembly of the invention, showing one example of a mounting base for the hoist.

As shown in FIG. 1, key features of the portable hoist system 100 in one preferred embodiment of the invention are a mounting body 10, a pivot mast or pivot tube 15 and a base or base mount mast 20, as well as a boom 50 and a strut or brace 45 secured to the boom. In the embodiment shown in FIG. 1, a bracket 25 is mounted to a structural tube 30, to which is further secured a mounting collar 35, which can be two spaced apart collars 35 as shown. These are shown as circular-cylindrical, but could be other shapes such as polygons if fitted onto a pivot tube so as to be stable and rotatable, which might include a pivot tube with spring elements such that the hoist clicks from notch to notch when swung to different positions about a generally vertical axis. A pivot connection 40 on the bracket 25 connects the support strut 45 to the bracket. A pivot axis/connection 55 connects the boom 50 to the bracket 25. The base 20 includes mounting guides or clamps 60 to secure the pivot mast 15. The pivot points 55, 40 are on the bracket 25 which is part of what can be referred to as the mounting body 10 of the hoist assembly. The mounting collars 35 allow for quick, easy removal of the hoist with boom 50 and support strut 45. The removable hoist assembly can then be moved to a different base, onto which the mounting body will be placed.

Figure 2:
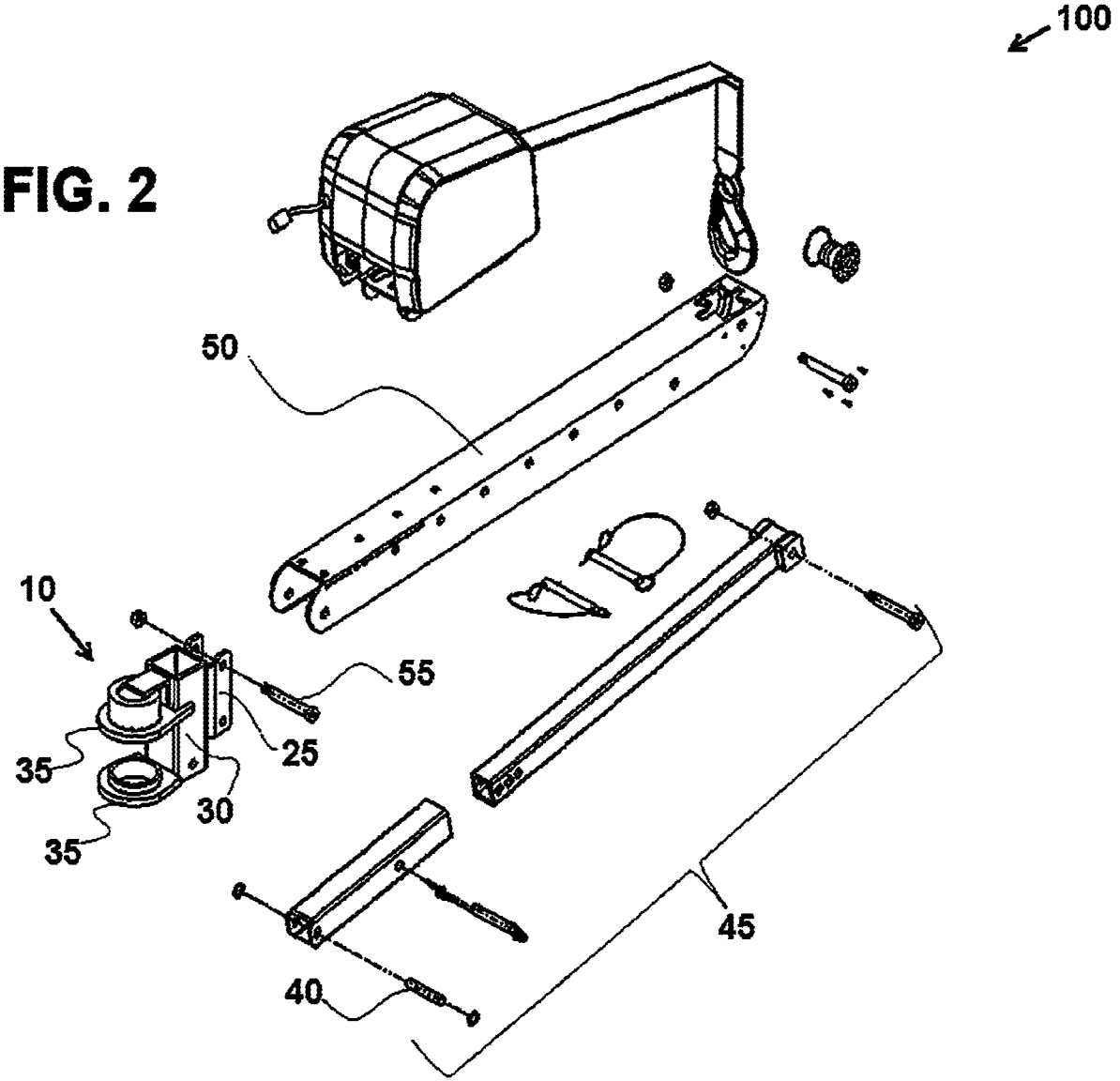
FIG. 2 is an exploded perspective view of the portable hoist system, including a powered lift mechanism along the boom.

As shown in FIGS. 1 and 2, the mounting body 10 includes the mounting collars 35, tubular structural member 30, and the bracket 25 which is fitted to provide the pivot axes 55, 40.

Figure 3A:
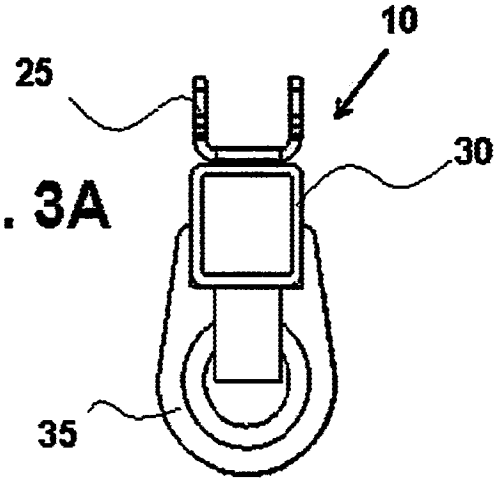
FIGS. 3A, 3B and 3C are bottom, front and side elevation views, respectively, of a first embodiment of a mounting body of the invention, shown removed from the base and without a boom and support strut.
Figure 3B:
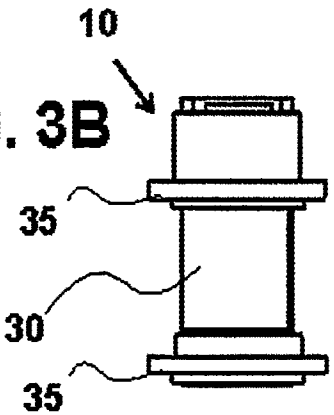
Figure 3C:
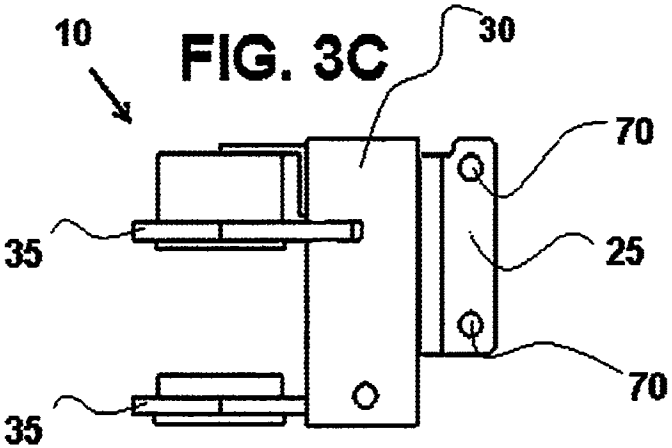

As shown in FIGS. 3A, 3B, and 3C, the mounting body or frame 10 includes the bracket 25 at one end, the structural tube 30 fixed to the bracket, and the mounting collars 35 at another end fixed to the tube. The bracket 25 is arranged to receive the boom 50 and a support strut 45 via pivot axis holes 70. The mounting body 10 can be placed on a base via either mounting collars 35 or the tube 30, which is non-circular and can be a square tube as shown.

Figure 4:
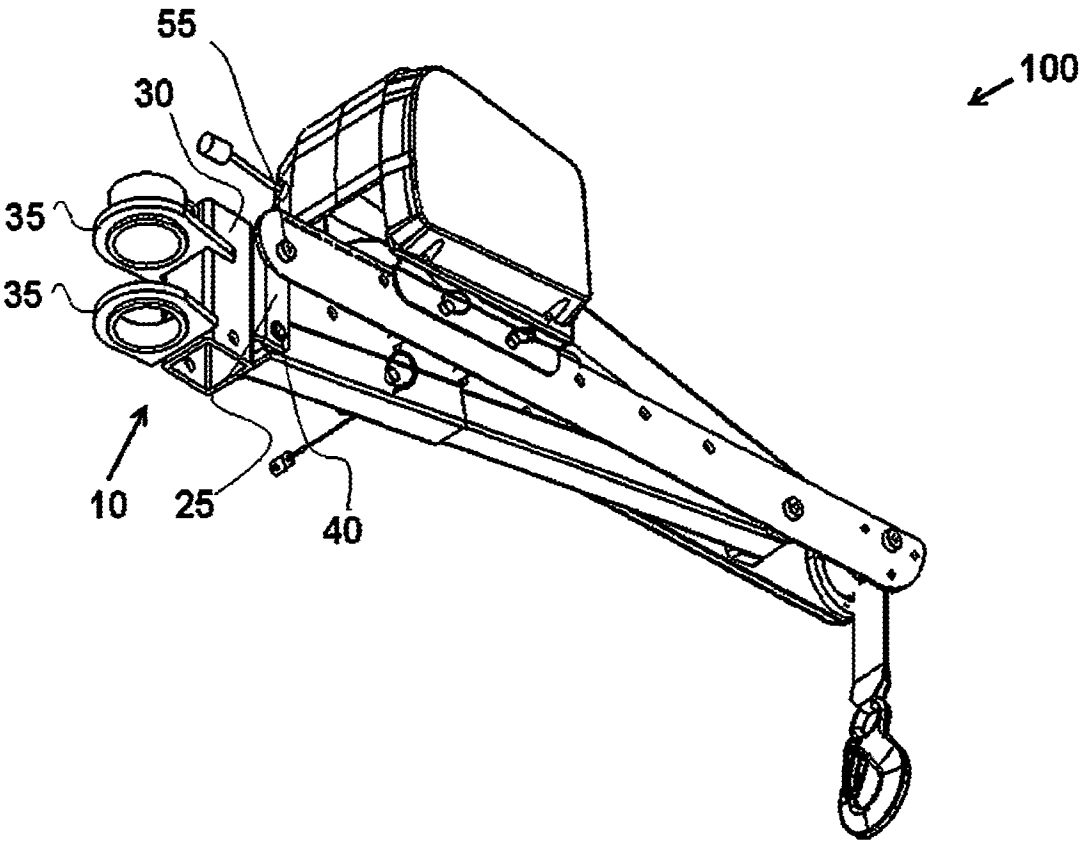
FIG. 4 is a bottom perspective view of the hoist assembly of FIG. 1, shown removed from a base mount.

FIG. 4 shows the mount body 10 with the remainder of the portable hoist assembly 100 attached at pivot axes 55, 40.

FIGS. 5A through 5F show the removable mount 10 interchangably mounted and removed from a pivot mast 15 via mounting collars 35, and from a non-round structural mast 65 via the non-round tube 3*a*. It should be understood that in another embodiment the non-round tube 30 could be omitted, with the mounting collars 35 secured directly to the bracket 25, if the use of a non-round structural mast 65 is not needed.

Figure 6B:
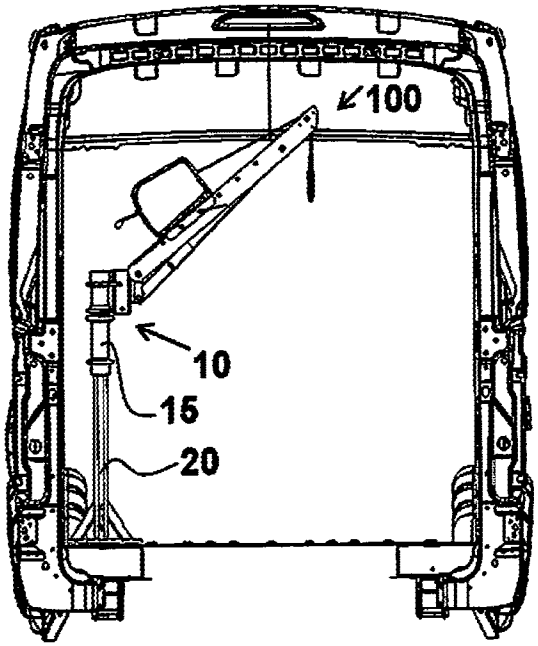
FIGS. 6A and 6B are rear elevation views of a van with the hoist assembly set up in the van on one form of mounting base of the invention, demonstrating the invention in a confined space, with FIG. 6A showing a stored position of the hoist and FIG. 6B showing an operating position.
Figure 6A:
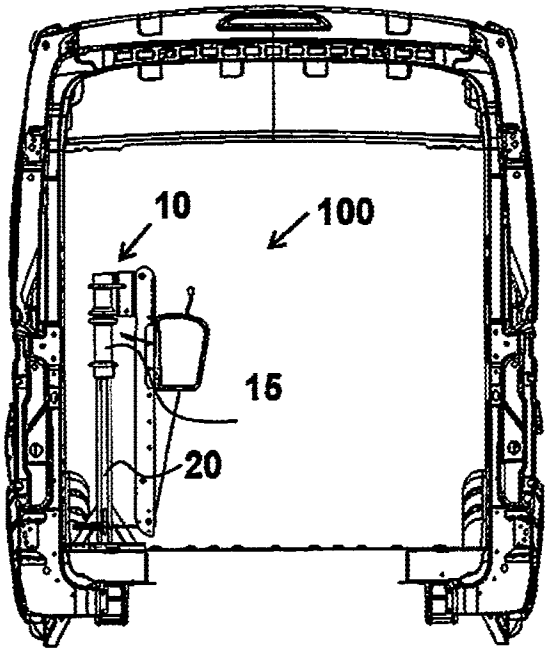

FIGS. 6A and 6B illustrate use of the portable hoist assembly 100 in a vehicle such as a van. Mounting apparatus 15, 20 (as in FIG. 1) support the hoist 100, with the structural component 20 fixed securely to the van's floor and preferably to vehicle frame structure below the floor. FIG. 6A shows the assembly folded down for storage in a confined space inside the van, while FIG. 6B shows the assembly erected up for lifting in the confined space of the van. The mounts also can be installed on a side door of the van to allow the crane to be moved between different positions (not shown).

Figure 5B:
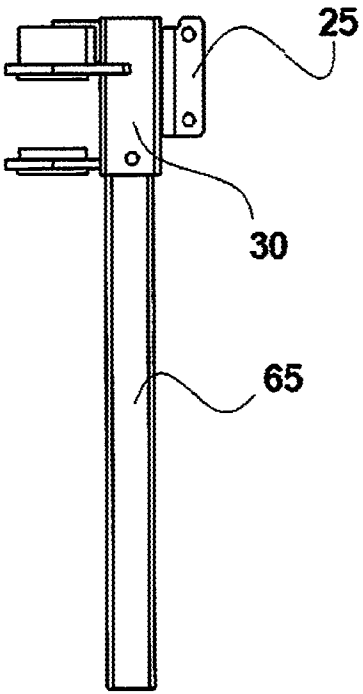
FIGS. 5A and 5B are side elevation views showing the mounting body of the hoist placed on two different types of mounting base, a pivot tube and a non-circular vertical mast. The boom and strut are not shown in these views.
Figure 5A:
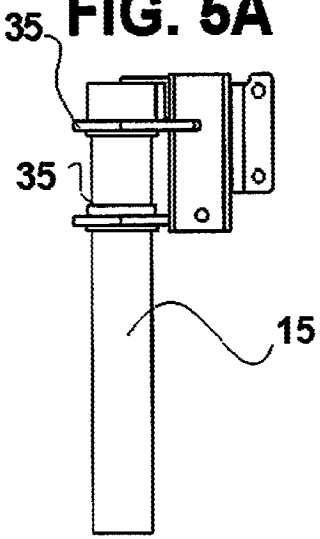
Figure 7:
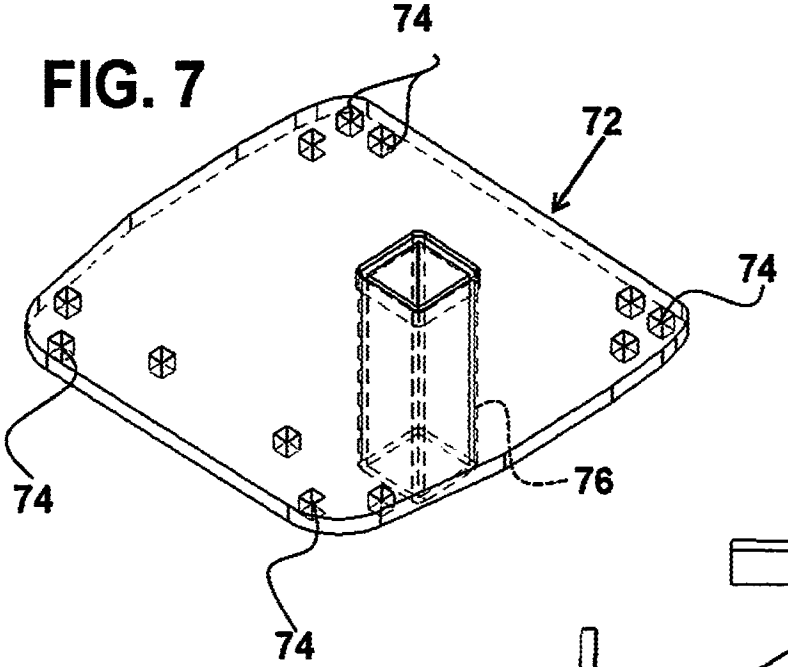
FIG. 7 is a perspective view of an additional embodiment of a base assembly showing a surface plate mount to receive a tube of a mounting base component.

FIG. 7 shows a floor mounting plate 72 to receive a non-round structural post or mast similar to the mast 20 seen in FIG. 1 or a mast 65 seen in FIG. 5B. Holes through the plate are shown at 74 for attachment to a floor or other rigid surface. The view in FIG. 7 is either a top perspective or a bottom perspective, depending on the orientation of a reinforcing socket 76. The reinforcing socket or tube is shown as a square tube rigidly secured to the plate, as by welding. Whichever the orientation, the socket 76 could have a closure on which the post can rest, or the post itself can have a limiting projection setting the depth to which it will sit in the plate and socket.

Figure 8:
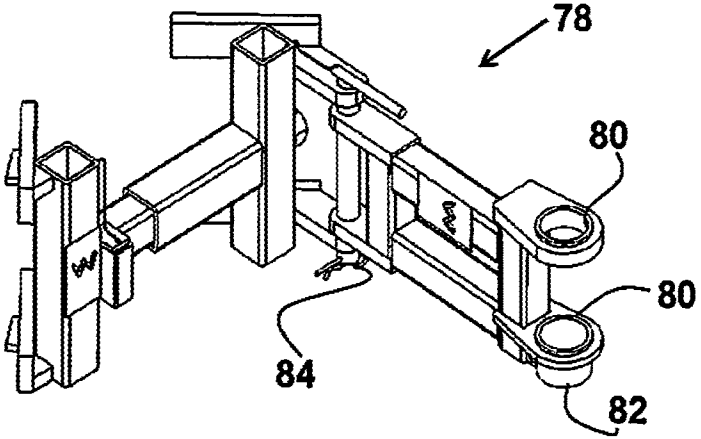
FIG. 8 is a perspective view showing the hoist with a door flange mount.

A door flange mount for the hoist assembly is shown in FIG. 8. This device, which can be the component sold as a Door Flange Mount by Spitzlift Inc. of Poway, Calif., is engaged on a door frame or door flange and tightened firmly with the provided threaded tighteners. The adapter, generally shown as 78, has a pair of cylindrical collars 80 which can be configured to receive a cylindrical pivot tube or mast such as shown at 15 in the drawings described above. A closure can be provided at 82, or the collar could be left open to allow the mast to rest against another surface. The adapter device 78 is versatile, having a vertical pivot axis at 84 so that, with pivoting at 84 and also at 80, the position of the hoist can be manipulated to be used in many irregular and confined spaces.

It should be understood that although cylindrical collars 80 are shown in FIG. 8 et seq., to receive the pivot tube or mast 15 (which can be as long as desired), or to receive the main upright mast of the embodiment of a hoist shown in U.S. Pat. No. 6,499,610, all of these collars could be replaced with non-circular sockets or collars, configured to receive a non-circular structural mast or post with a cross section such as shown at 20 in FIGS. 1, 6, etc. Such a non-circular mast would then be secured to a pivot tube 15 such as shown in FIG. 1, or the non-circular mast could be fitted into the other tubular member 30 shown in FIGS. 1-5F.

Figure 9:
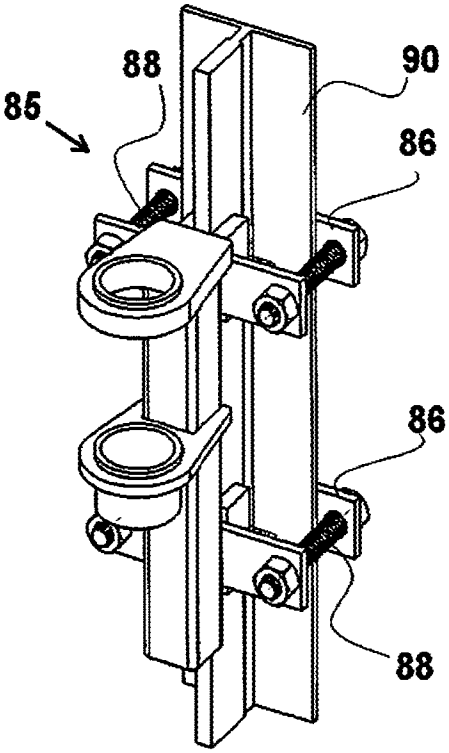
FIG. 9 is a perspective view showing a mounting base secured to a vertical rail or column.

FIG. 9 shows a base mount adapter 85 with clamps 86 and threaded fasteners 88 for clamping onto a structural post or building component, rigid fence post or other structural feature in a building, elevator shaft, on a vehicle, etc. Such a vertical post is shown at 90. This adapter can receive a pivot tube 15 as in FIG. 1, of any length.

Figure 10:
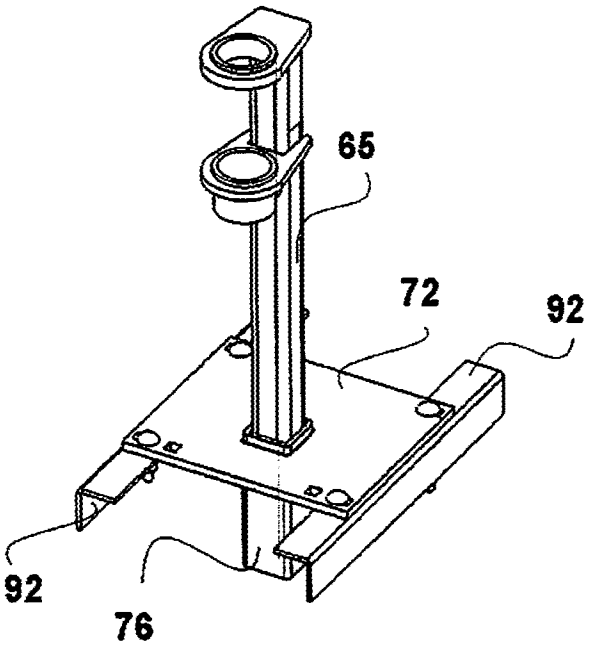
FIG. 10 is a perspective view of a horizontal plate mount.

FIG. 10 shows a floor plate 72 which can be similar to that shown in FIG. 7, to receive a mast 65, but with further horizontal structural members 92 that can be angle irons as shown. The members 92 can be of any length needed. Such reinforcing structure can be used, for example, under a floor, up against the bottom of the floor. Such a floor could be on a vehicle or an industrial floor, wood floor or deck, etc. A hole is provided in the floor for the reinforcing socket 76, and the mast 65 can then be inserted down into the socket through the floor.

Figure 11:
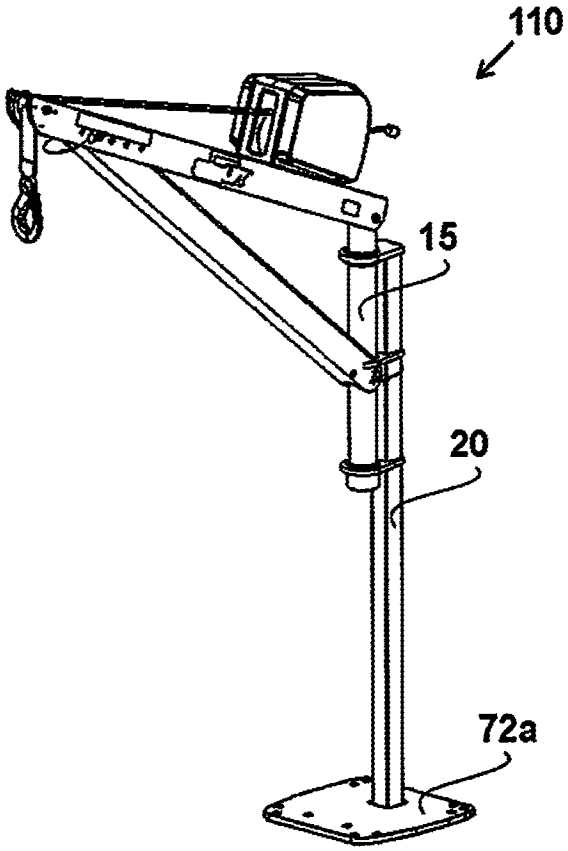
FIG. 11 is a perspective view of an embodiment of a portable hoist supported on a surface mount.
Figure 11A:
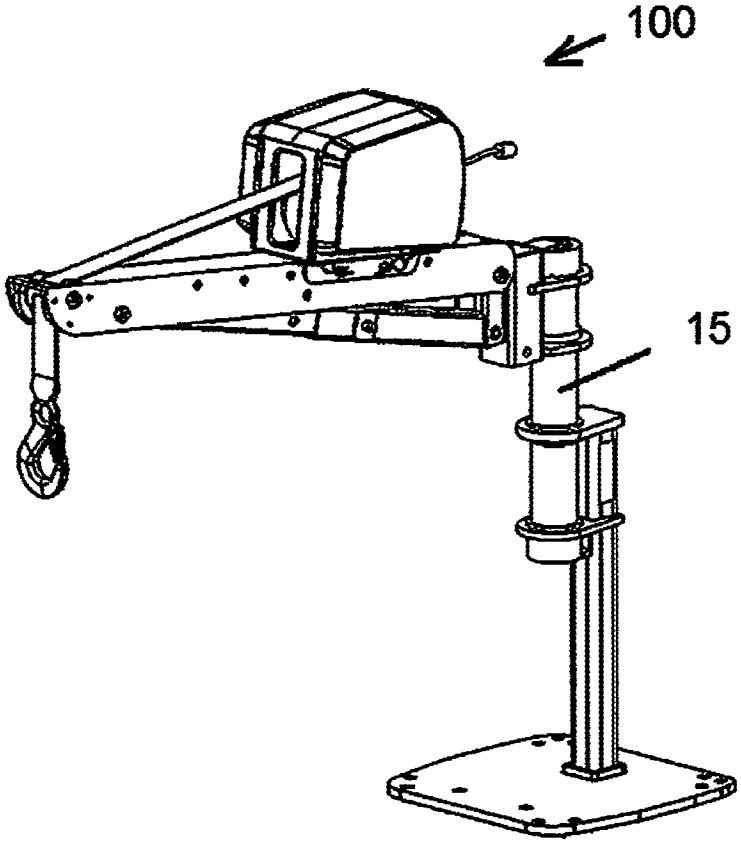
FIG. 11A shows a system similar to FIG. 11.

FIG. 11 shows a hoist assembly 110 of the type shown in the above-referenced prior patent, as an example, attached to a structural mast 20 and supported on a floor surface base mount 72*a*, which can be similar to the base mount 72 shown in FIG. 7, with or without a reinforcing socket. Without the socket, the column or mast 20 is rigidly affixed, as by welding, to the floor plate 72*a*. As shown in FIG. 11A, the hoist assembly 100 of FIG. 1 can also be supported on such a floor-mounted mast 20, with the hoist 100 attached onto the top of the pivot tube 15 shown in FIG. 11, via the mounting collars 35 that provide for swiveling.

Figure 12A:
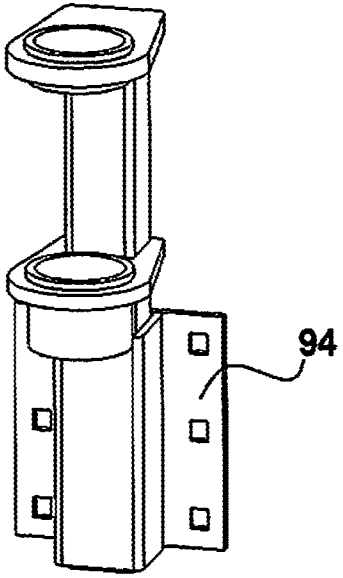
FIGS. 12A and 12B are perspective views of base mounts for attachment to vertical surfaces, at various heights.
Figure 12B:
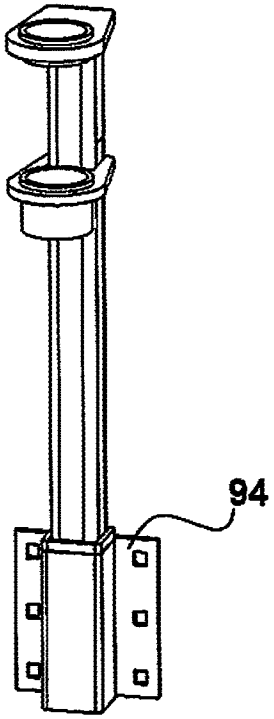

FIGS. 12A and 12B show vertical base mounts, with upright flat plates 94 adapted to be screwed or bolted onto a wall or other essentially flat surface providing a stable anchoring for the hoist. Height can be adjusted. Such a mounting can receive a pivot tube that in turn receives the FIG. 1 hoist assembly 100.

Figure 14:
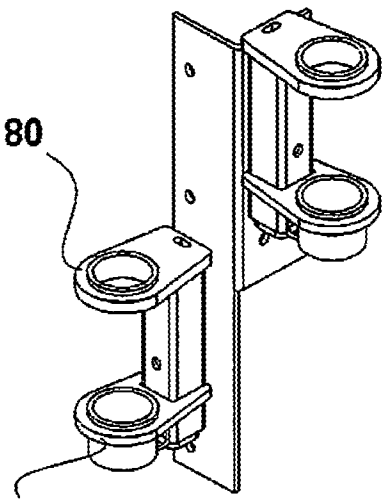
FIG. 14 is a perspective view showing of a double corner mounting base which can be used in a service truck for two different hoist positions.
Figure 13:
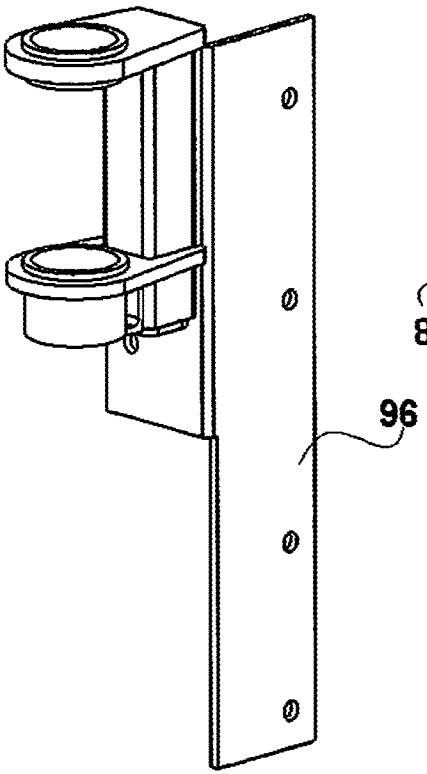
FIG. 13 is a perspective view of a base mount for attachment to a vertical surface.
Figure 15:
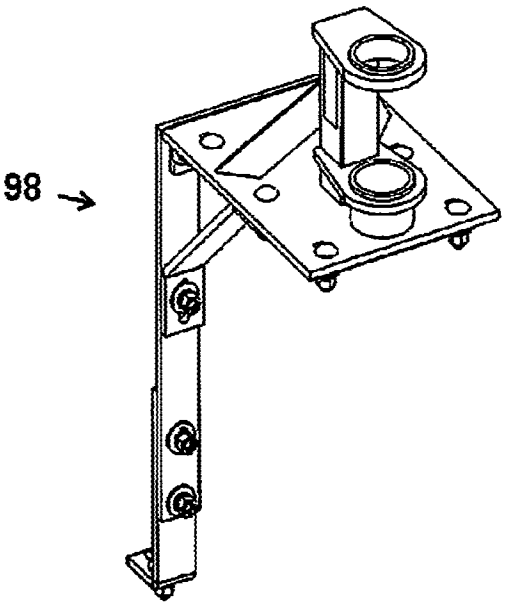
FIG. 15 is a perspective view of another base mount for securing in a service truck.
Figure 17:
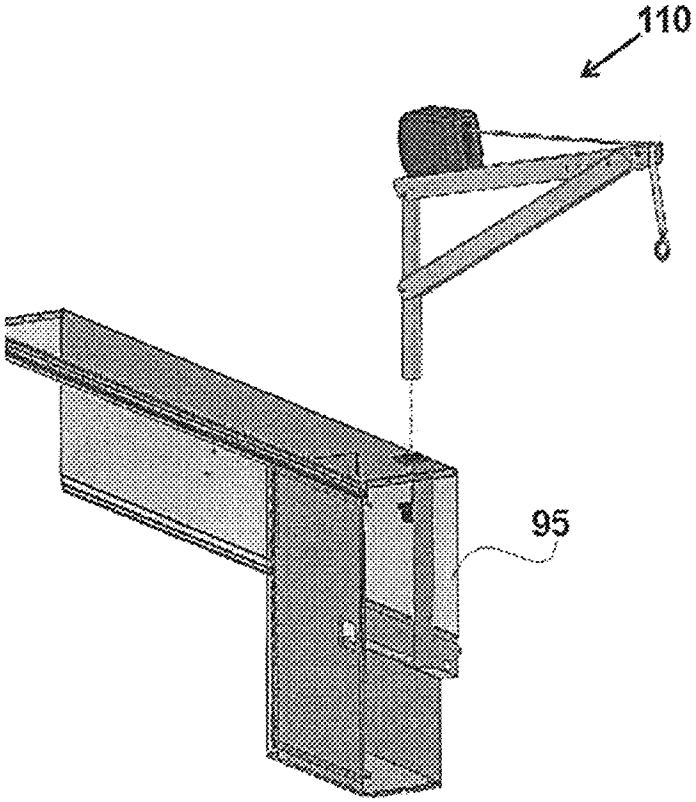
FIG. 17 is a perspective view of a base mount installed inside a service vehicle, to receive a hoist assembly.

FIGS. 13, 14 and 15 show other forms of mounting bases, which can be used in several different environments and are particularly adapted for use in a service truck, such as in a storage box or compartment 95 such as shown in FIG. 17. In FIG. 13 a mounting plate 96 is at right angles to those plates 94 shown in FIG. 12A, 12B, and FIG. 14 is similar but with an additional set of mounting collars so that a portable hoist can be attached at either location, or two hoists could be used if desired. FIG. 15 shows a base structure 98 that can be positioned down in a service truck compartment such as shown at 95 in FIG. 17.

Figure 16:
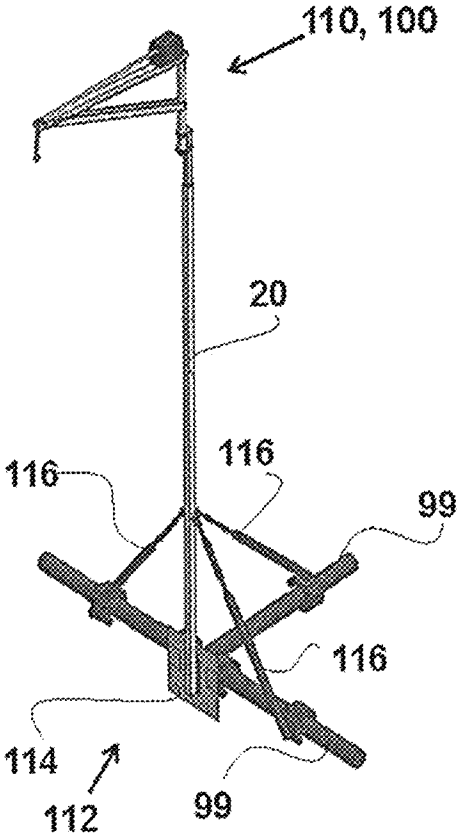
FIG. 16 is a perspective view of a base mount mast secured to intersecting horizontal structural members.

FIG. 16 shows intersecting structural members 99 of a building or other stable structure, possibly on a vehicle, to which a mounting base adapter 112 can be secured. A mast 20 is shown, supporting at its top a portable hoist assembly 110 or 100. A bottom plate 114 on the mast is secured to one of the structural members, and supporting rods 116 with turnbuckles are shown stabilizing the mast.

FIG. 17 illustrates a hoist 110 being inserted into base mounting apparatus within a service truck compartment 95, as mentioned above. The portable hoist could be the hoist 100 shown in FIG. 1, with the pivot tube a separate component to be engaged by the mounting collars 35 of that hoist.

Figure 18:
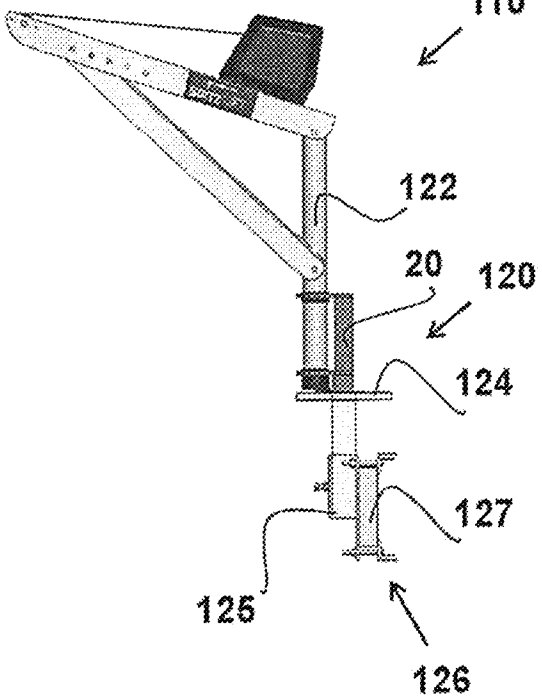
FIG. 18 is a side view of a portable hoist system supported on another form of base mount.

Another form of base mount 120 is shown in FIG. 18. Although illustrating the base mount assembly 120 supporting portable hoist 110 of U.S. Pat. No. 6,499,610, can preferably also be the hoist 100 shown in FIG. 1. The pivot tube 15 shown in FIG. 1, as a separate component used with the hoist 100, can extend down in the position of the mast 122 shown. Alternatively, a vertical structural component 20 in the base assembly 120 can extend up to perform the function of the upright member 20 shown in FIG. 1, being secured to a pivot tube 15. In any event, the base assembly 120 includes an escutcheon plate 124 for situations where needed, and understructure 125, 126 which can be, for example, under the floor of a vehicle or deck, secured to stable structure. The box tube 125 has a set screw 125*a* to engage with the upright member 20, and it is secured to a clamp 126 that grips onto a beam indicated at 127.

Figure 19:
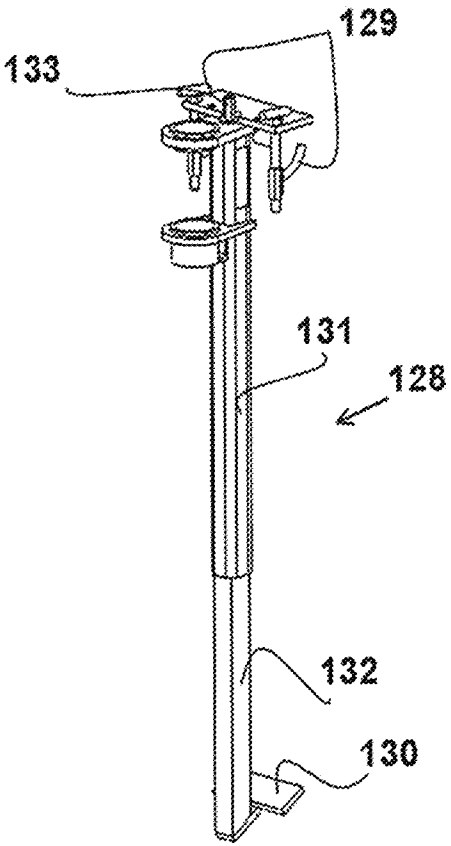
FIG. 19 is a perspective view showing another form of base mount for a hoist of the invention.

FIG. 19 shows another example of a base mounting 128 that can be used in certain applications for supporting the hoist of the invention. This can be used, e.g., on a vehicle such as a train car that has a horizontal rail and a lower flange, edge or rail. Clamps 129 at an upper part of the mount are configured to grab onto a rail, while a foot plate 130 engages under a bottom edge or a flange or rail. The length (height) of the mounting device is adjustable. Upper and lower main components 131 and 132 are drawn closer together via a tool stem 133 to which a tool can be attached to rotate a threaded rod (not shown) within the component 131. This mounting device is configured to receive a pivot tube 15 which receives the hoist assembly 100 (not shown).

Figure 20:
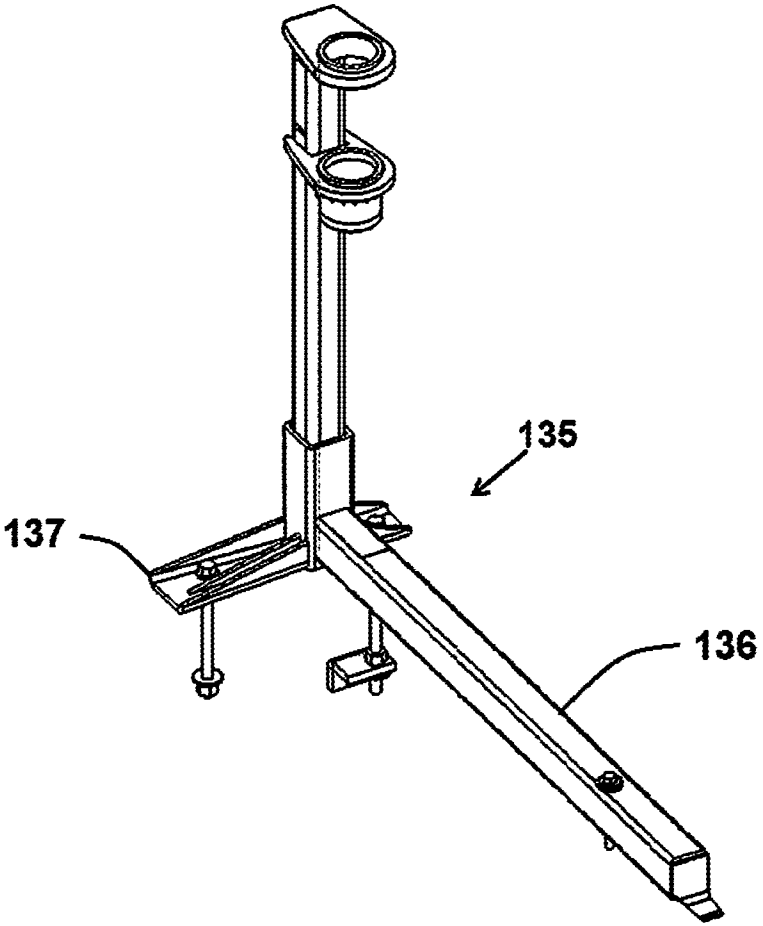
FIG. 20 is a perspective view showing a clamp locking mount for a particular small truck.

FIG. 20 shows another base assembly 135, in this case for use with a particular vehicle, a Ford Transit Connect truck. An elongated tongue 136 of the mounting device is secured in the interior of the vehicle, after a rear seat has been removed. A plate/clamp assembly 137 attaches against the floor near the rear and to stable understructure of the truck. Note that a somewhat similar mounting base, with a shorter tongue (not shown) and without the assembly 137, can be used to secure a portable hoist with a trailer hitch box (square) of a vehicle.

Figure 21:
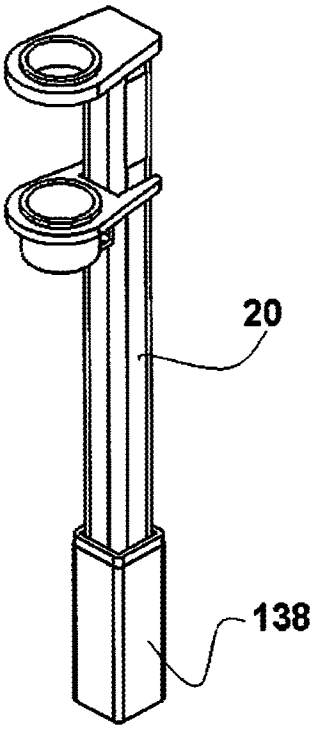
FIG. 21 is a perspective view of a weld-in base mount.

FIG. 21 shows another simple base support for a portable hoist assembly of the invention. A base socket piece 138 is provided, for welding to a stable anchoring structure. The upright member 20 is received inside the socket.

Figure 22:
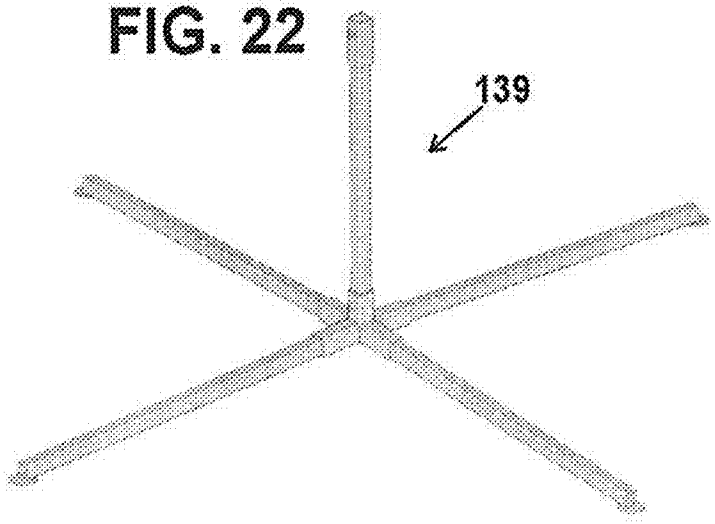
FIG. 22 is a perspective view of a quad stand base mount.

FIG. 22 shows a four-legged stand 139 as a base for hoists according to the invention.

Figure 23:
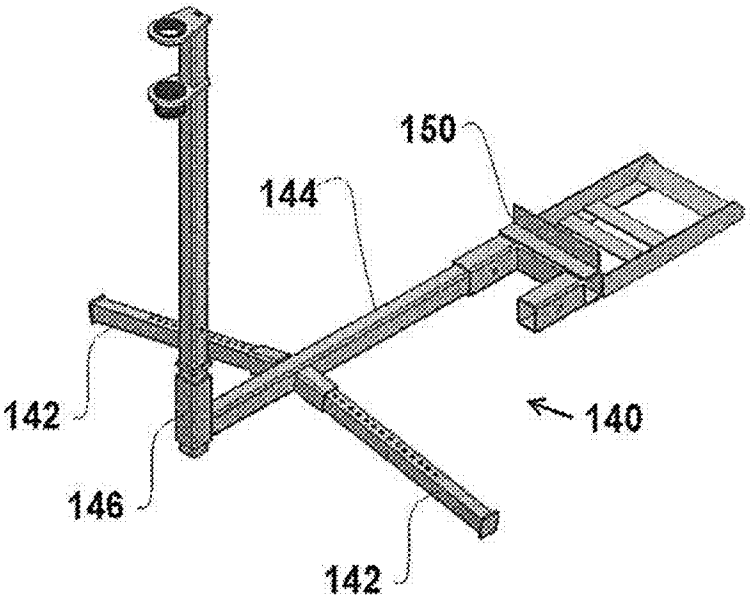
FIG. 23 is a perspective view of a wheel stand base mount that depends for stability on the weight of a vehicle.

FIG. 23 shows a wheel stand base mount 140 for hoists of the invention. Lateral legs 142 rest against the ground or floor and a main horizontal structural member 144 extends back from a mounting adapter end 146 to a wheel bearing platform 148. These components can be disassembled as indicated in the drawing. For anchoring support, one wheel of a truck or other vehicle is driven onto the wheel platform 148, which has a bump stop 150 as shown.

Figure 24:
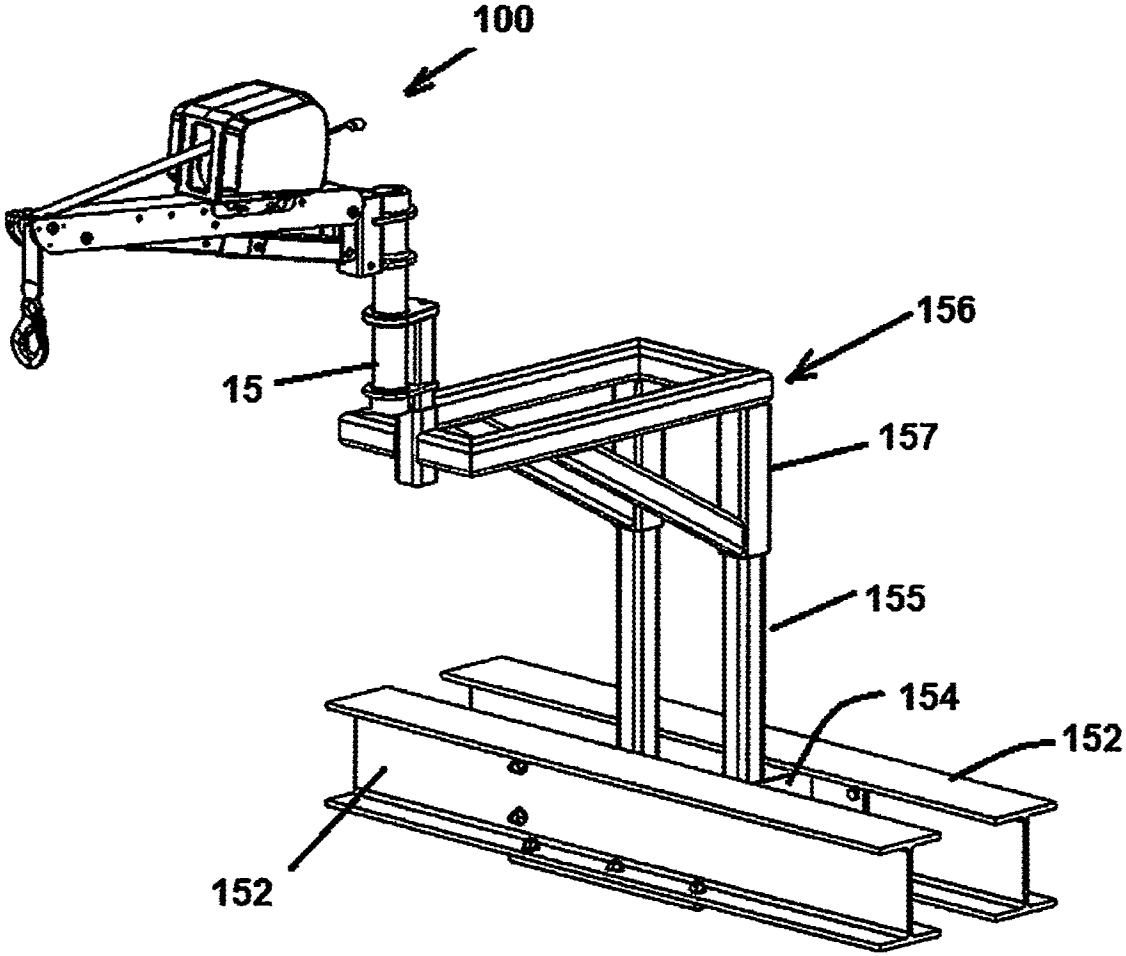
FIG. 24 shows another base mount structure.

FIG. 24 shows two roof beams 152, between which a clamp device 154 is engaged. Two uprights 155 extend up from the clamp, and a frame 156 has tubular legs 157 that fit onto the uprights 155. The frame supports the pivot tube 15 of FIG. 1 for a hoist 100. Note that the clamp device could support a single upright 155 if desired, which in turn would support mounting elements such as described above, for the portable hoist.

Figure 25:
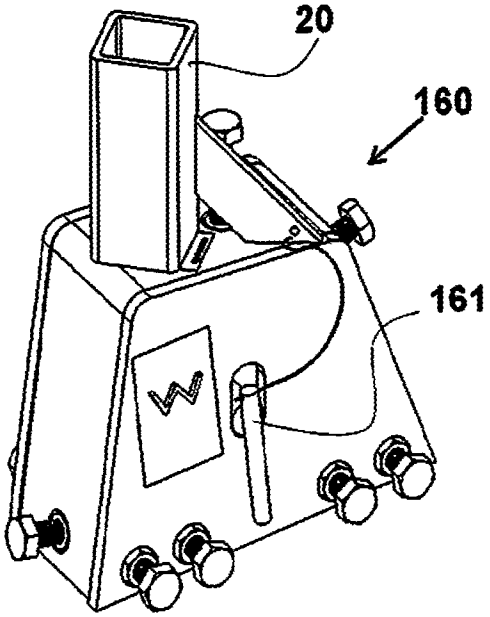
FIG. 25 shows an adapter for a lift eye.

FIG. 25 shows an adapter base 160 which engages over a lift eye, i.e. a firmly secured loop or eye extending upwardly from a floor, beam or other surface. The device 160 engages through the lift eye using a pin 161, and an upright adapter 20 (which could be a socket for an upright 20 as seen in FIG. 1) is provided to support hoist mast apparatus described previously. Set screws 162 can be used to engage structure that provides a base of the lift eye.

Figure 26:
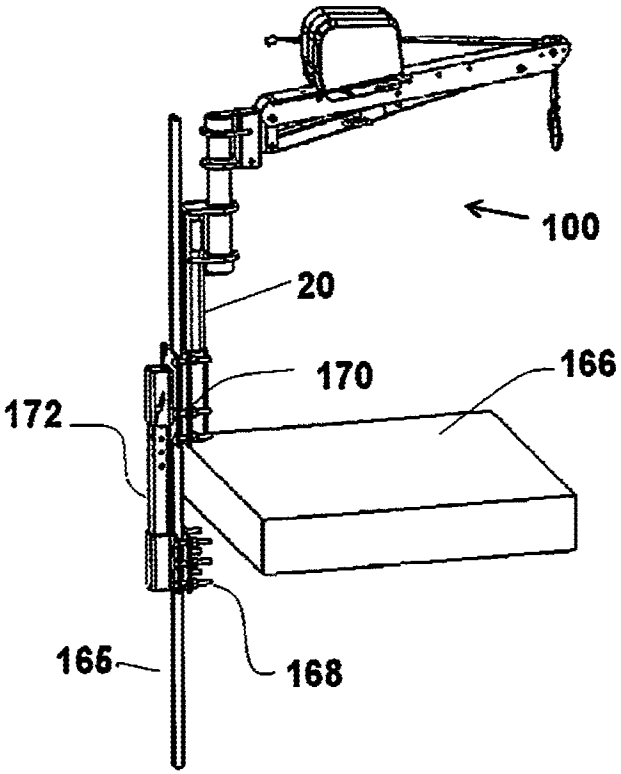
FIG. 26 shows a base mount adapter for a vertical rail.

FIG. 26 shows a portable hoist 100 or 110 supported on a vertical rail 165. A platform or walkway 166 is shown adjacent to the rail, but does not support the hoist. Clamps 168 and 170, tightened by threaded fasteners, draw a backing bar or plate 172 against the rail 165. The clamp assembly 170 supports an upright structural member 20 for supporting a portable hoist assembly 110 or 100.

As will be understood by those of ordinary skill in the art, the portable hoist system 100 with quick-release mounting body 10 can easily be mounted upon any platform such as the deck of a dock, the bed of a trailer, a truck or train car, a watercraft, or even in a large aircraft, on a pole, a building, a bridge, a platform, a tower, or any other structure providing stability. The portable hoist system 100 can also be folded and retained as one compact unit for portability or stowing, without the need for disassembly.

When the lifting and moving job is completed, the portable hoist system 100 can be removed from a supporting body simply by lifting the collar 35 off a pivot tube, and can be folded up and retained as one unit in a neat bundle and carried down a ladder or a stairway to the next location. It has been found that a portable hoist system 100 made of structural aluminum and steel weighs about 30 to 40 pounds and can have a maximum lifting capacity of about 1000 pounds. Aluminum is chosen for major components of the preferred embodiment because it remains cool to the touch even in hot weather, it resists corrosion, and is inexpensive and light in weight. The adjustable strut mechanism can be steel. Other metals such as titanium or composites may also be used, preferably keeping the weight of the hoist so as not to exceed a weight easily transportable by an individual.

More specifically, the boom may be constructed of lightweight material so as to not exceed 50 pounds total weight of the assembly in a preferred embodiment (and preferably less, 30 or 40 pounds). The portable hoist 100 preferably has a load capacity to hoist weight ratio of 15 to 40, more preferably 30 to 40, and most preferably above 35.

Many variations of the present invention are available. For example, the bracket 25 could be attached directly to the mounting collars 35, without the tube 30 in a different configuration (not shown); or the bracket 25 could be attached directly the tube 30 without the mounting collars 35 attached (not shown), so that the non-round tube 30 is slipped onto an upright mast of appropriate shape such as the mast 20. Still other arrangements are possible, as discussed above.

Those of ordinary skill in the art will also realize that two or more hoists may be used with one vehicle to lift particularly heavy loads, off-balance loads, or exceptionally large equipment.

Once installed, in a preferred embodiment, the portable hoist system 100 of the present invention may be used to lift a variety of different loads heretofore not movable by a single person. Such loads may include, but are not limited to: palletized loads, small yard machines, tree stumps, automobile engines, farm equipment, large truck tires, furniture, small off-road vehicles, deer, generators, large poles, small watercraft, rocks, small motorcycles, fuel/oil drums, and articles in the military, oil, power, utility, solar/wind/alternative energy and railroad industries, as well as other industries.

Once a lifted item has been placed in a preferred location, the portable hoist assembly 100 of the present invention is simply lifted from its mounting and configured for storage and retained as a single unit, or it may remain in place and folded down for storage, remaining as one unit.

Those of ordinary skill in the art will understand that numerous improvements and modifications may be made to the disclosed versatile mounts for a portable hoist system without departing from the scope of the invention. Such improvements and modifications may include, but are not limited to: adding a weight indicator; including a bearing connection such as ball bearings in the connection between the pivot tube and the support body of the hoist; including a light system for night operations; adding a motor drive or power assist to assist in the rotation of the hoist support assembly about a vertical axis; reinforcing the support strut mechanism with a thicker cross section at specific locations.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A portable hoist apparatus capable of efficient setup and removal in a series of different hoist support arrangements, comprising:

the portable hoist apparatus including a boom, a tension line supported over the boom, a lift mechanism for operating the tension line, and a frame or body to which the boom is attached, the body including a bracket to which the boom is connected, and the body further including a circular cylindrical collar on a generally vertical axis, the collar being connected to the bracket, and further including a non-circular hollow open-bottomed structural post-receiving member oriented with an axis generally vertical and secured directly to said bracket on one side and to said collar on an opposite side, whereby the portable hoist can be supported with the collar slipped over a generally vertical cylindrical pivot tube connected to any of various stable anchoring structures to support the hoist and to allow for swinging of the portable hoist about a generally vertical axis at the pivot tube, or the portable hoist can be supported with the non-circular hollow structural member slipped over a non-circular post to support the portable hoist and to prevent pivotal swinging of the portable hoist.

2. The portable hoist apparatus of claim 1, wherein the non-circular structural member is a square tube.

3. The portable hoist apparatus of claim 1, further including a base mounting post secured to a stable anchoring structure and complementarily shaped to and fitted to said non-circular structural member to support the hoist as an alternative to use of the collar.

4. The portable hoist apparatus of claim 1, including a base plate secured to a stable anchoring structure, an upright mast extending up from the base plate, and said pivot tube being connected to the upright mast so that the upright mast supports the portable hoist.

* * * * *